US010313794B2

(12) United States Patent
Kanoko

(10) Patent No.: US 10,313,794 B2
(45) Date of Patent: Jun. 4, 2019

(54) SPEAKER SYSTEM

(71) Applicant: Tomoaki Kanoko, Sendai (JP)

(72) Inventor: Tomoaki Kanoko, Sendai (JP)

( * ) Notice: Subject to any disclaimer, the term of this patent is extended or adjusted under 35 U.S.C. 154(b) by 0 days.

(21) Appl. No.: 15/947,541

(22) Filed: Apr. 6, 2018

(65) Prior Publication Data

US 2018/0295447 A1 Oct. 11, 2018

(30) Foreign Application Priority Data

Apr. 9, 2017 (JP) ..... 2017-86640
Jan. 12, 2018 (JP) ..... 2018-14130

(51) Int. Cl.
*H04R 1/02* (2006.01)
*H04R 5/02* (2006.01)
*H04S 1/00* (2006.01)

(52) U.S. Cl.
CPC ..... *H04R 5/02* (2013.01); *H04R 1/02* (2013.01); *H04S 1/002* (2013.01); *H04S 2400/15* (2013.01)

(58) Field of Classification Search
CPC . H04R 5/02; H04R 1/02; H04R 1/002; H04R 1/025; H04R 2205/022; H04R 2205/024; H04R 2201/02; H04R 2201/025; H04R 2201/028; H04S 2400/15; H04S 1/002; H04S 3/00
USPC ..... 381/87, 300, 332, 333, 335, 336
See application file for complete search history.

(56) References Cited

U.S. PATENT DOCUMENTS 4,418,243 A * 11/1983 Fixler ..... H04R 5/02 181/144
4,593,784 A * 6/1986 Flanders ..... H04R 1/345 181/144
2011/0216926 A1* 9/2011 Riggs ..... H04R 5/02 381/300

FOREIGN PATENT DOCUMENTS

JP H10-304490 A 11/1998
JP H10-313493 A 11/1998
JP H11-239398 A 8/1999
JP 2006-060330 A 3/2006
JP 2006-060330 * 3/2011 ..... H04R 5/02

* cited by examiner

*Primary Examiner* — Ahmad F. Matar
*Assistant Examiner* — Sabrina Diaz
(74) *Attorney, Agent, or Firm* — Yokoi & Co., U.S.A.; Toshiyuki Yokoi

(57) ABSTRACT

The present invention is a speaker system for reproducing sound close to the actual sound of instruments or actual acoustic field. The instruments output sounds in various directions. For example, reverse phase sound is output and human voice is output in forward direction. Therefore, the speaker capable of reproducing stereophonic sound close to the original sound without limiting a listening point is required. In a speaker cabinet 5, left and right speakers 3, 4 are arranged back to back with each other to output normal phase sound and reverse phase sound from left and right. Front left and front right speakers 1, 2 are slightly facing to each other to output the sound like a voice by a point sound source. Sounds of the front speakers and left and light speakers are overlapped with each other and stereophonic sound can be reproduced.

3 Claims, 1 Drawing Sheet

SPEAKER SYSTEM

CROSS-REFERENCES TO RELATED APPLICATIONS

This patent specification is based on Japanese patent application, No. 2017-86423 filed on Apr. 9, 2017 and No. 2018-14130 filed on Jan. 12, 2018 in the Japan Patent Office, the entire contents of which are incorporated by reference herein.

BACKGROUND OF THE INVENTION

1. Field of the Invention

The present invention relates to a speaker system for reproducing sound close to the actual sound of instruments or actual acoustic field.

2. Description of Related Art

In the conventional speakers, it is considered to be important to reproduce sound sources faithfully by collecting a part of the sound generated from the instruments and eliminating reverse phase sound. However, the sound generated from the instruments is spread in various directions and the spread of the sound varies depending on the instrument and voice. Thus, it is impossible to reproduce the sound close to the actual sound of instruments only by reproducing the collected sound in forward direction. In addition, it is necessary to determine a listening point for listening the center of the sound clearly.

A lot of reproduction methods have been attempted to reproduce the sound closer to the actual music. The Speaker Matrix system is one of the reproduction methods. However, when the wiring is changed, there is a disadvantage of imposing a burden on an amplifier. In the worst case, there is a risk of damaging the amplifier in the Speaker Matrix system.

Various speaker systems have been developed to mount a plurality of speakers in multiple directions so as to reproduce the sound close to the original sound by outputting the sound in multiple directions. However, even when the speakers are mounted in multiple directions, the same sound is output from the plurality of speakers. Because of this, human voices and the like are spread to the left and right, for example. Thus, the output sound is inferior to the actual sound.

In this respect, there is a method of using a surround system in which the sound signals are processed digitally to reproduce the sound closer to the actual acoustic space. However, a device for exclusive use is required. In addition, the surround system is a system for listening the sound from 360 degrees by separating the sound into L (left), R (Right) and Center. Thus, the surround system is not a system for reproducing the sound close to the original sound of the instruments.

There is an attempt to arrange speakers facing to each other for listening the sound clearly. However, the attempt does not aims for reproducing the stereophonic sound and the original sound. In addition, since the sound cannot be spread to the left and right, the output sound is far from the original sound.

BRIEF SUMMARY OF THE INVENTION

In the present invention, the reverse phase sound is not eliminated to a maximum extent, the output sound is made close to the waveform of the sound of various instruments and voices, and the sound played in the actual live hall is reproduced. Consequently, the present invention enables listeners to enjoy music without limiting the listening point.

DETAILED DESCRIPTION OF THE INVENTION

Figure 1:
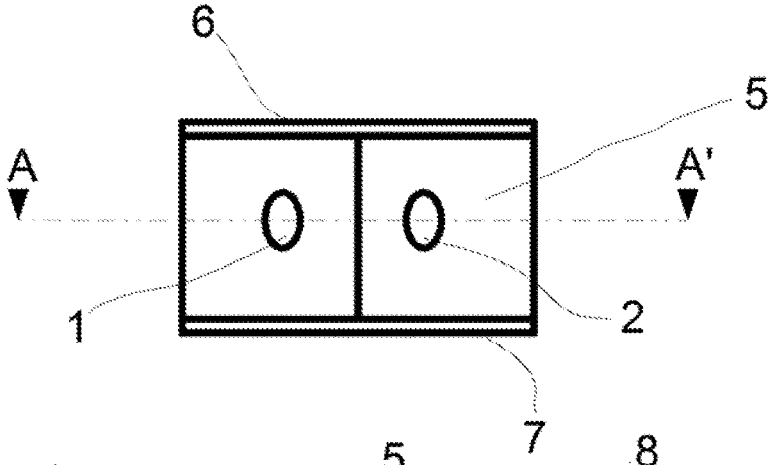
FIG. 1 is a front view of a speaker system of the present invention.

A pair of left and right speakers 3, 4 for left and right channels of a stereo audio are mounted respectively on left and right sides of a speaker cabinet 5 so that the left and right speakers 3, 4 are arranged back to back with each other. The reverse phase sound output from a rear side of the left and right speakers 3, 4 is not interrupted by an obstacle in the speaker cabinet 5. A space between back surfaces of the left and right speakers 3, 4 is not interrupted by an obstacle in more than 50% area of a whole area of the back surfaces so that the reverse phase sound output from one of the left and right speakers 3, 4 is interfered with the reverse normal sound output from the other of the left and right speakers 3, 4. In other words, the reverse phase sound output from one of the left and right speakers 3, 4 acts on the other of the left and right speakers 3, 4. The reverse phase sound output from the left and right speakers 3, 4 and center sound/normal phase sound reduced by the reverse phase sound come out from ducts 8 located at left and right sides of the speaker cabinet 5.

A pair of front left and front right speakers 1, 2 for the left and right channels are mounted horizontal to each other on the speaker cabinet 5 at a front side in a front-rear direction and a center side in a left-right direction compared to the left and right speakers 3, 4 so that the front left and front right speakers 1, 2 are slightly facing to each other sandwiching a center of the front face of the speaker cabinet 5. Here, a shielding plate or the like is provided between the front left and front right speakers 1, 2 and the left and right speakers 3, 4 to prevent an interference. The speakers 1-4 are arranged so that a first straight line connecting the left and right speakers 3, 4 intersects second straight lines extending backward from each of the front left and front right speakers 1, 2, and third straight lines extending forward from each of the front left and front right 1, 2 intersect with each other in front of a listening point (listener) L.

Figure 2:
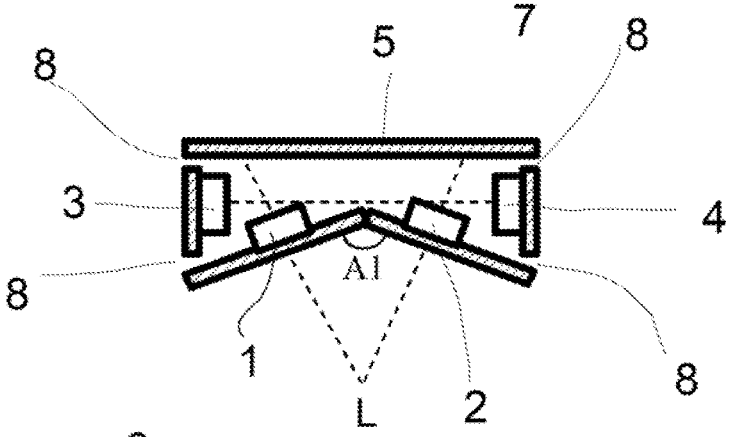
FIG. 2 is a top view of a cross-sectional view cut along an arrow A-A' in FIG. 1 in the speaker system of the present invention.
Figure 3:
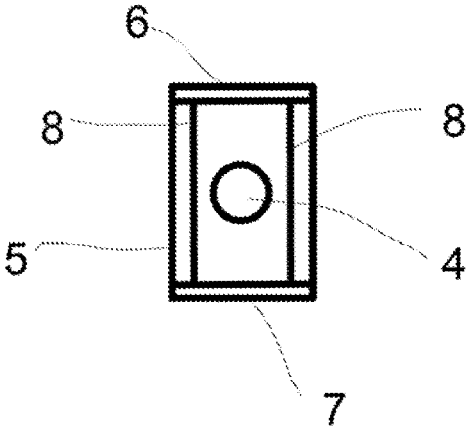
FIG. 3 is a right side view of the speaker system of the present invention.

If an angle of facing the front left and front right speakers 1, 2 is too small, the sound is muffled and it doesn't sound like a voice. Therefore, the angle A1 of facing the front left and front right speakers 1, 2 is approximately 90° to 150°. In FIG. 2, the angle A1 is set to 140°.

From the actual instruments, normal phase sound and reverse phase sound are output over a wide range. The sound close to the actual instruments can be output by the normal phase sound output from the left and right speakers 3, 4 and the front left and front right speakers 1, 2 and the reverse phase sound of the left and right speakers 3, 4 output from the ducts 8.

As for the center sound, since the front left and front right speakers 1, 2 are facing with each other and straight lines extended from each of the left and front right speakers 1, 2 intersect with each other at the front side, the sound similar to the human voice is output. Consequently, clear sound can be obtained without limiting a listening point.

Because of the effects described above, the sound of the instrument is reproduced near the left and right speakers 3, 4, and the sound like human voice or wind instrument is reproduced near the center. Thus, the acoustic space similar to band performance in a live hall is reproduced, for example.

The sound can be enjoyed in indoors or outdoors by connecting with a normal audio amplifier or being equipped with a wireless function.

INDUSTRIAL APPLICABILITY

When the speaker system of the present invention is designed in combination with a thin television, the sound of the television is changed into more realistic sound. Thus, the television can be enjoyed more.

When the speaker system of the present invention is combined with an acoustic device of amusement equipment, more realistic amusement equipment can be designed.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

DESCRIPTION OF SYMBOLS

1: front left speaker
2: front right speaker
3: left speaker
4: right speaker
5: speaker cabinet
6: ceiling of speaker cabinet
7: bottom portion of speaker cabinet
8: duct

What is claimed is:

1. A speaker system, comprising:

a speaker cabinet; and a pair of left and right speakers mounted respectively on left and right sides of the speaker cabinet, the left and right speakers being arranged back to back with each other; and a pair of front left and front right speakers mounted horizontal to each other on the speaker cabinet, wherein a space between back surfaces of the left and right speakers is not interrupted by an obstacle in more than 50% area of a whole area of the back surfaces so that a reverse phase sound output from one of the left and right speakers is interfered with a normal phase sound output from the other of the left and right speakers, the reverse phase sound output from the left and right speakers comes out from ducts located at left and right sides of the speaker cabinet, the front left and front right speakers are facing to each other with an angle of 90° to 150°, and the front left and front right speakers are mounted on a front side in a front-rear direction and a center side in a left-right direction compared to the left and right speakers.

2. The speaker system according to claim 1, wherein a first straight line connecting the left and right speakers intersects second straight lines extending backward from each of the front left and front right speakers, and third straight lines extending forward from each of the front left and front right speakers intersect with each other in front of a listening point.

3. The speaker system according to claim 1, wherein the ducts are provided on both front and rear ends of the left and right sides of the speaker cabinet.

* * * * *